US012746638B2

(12) United States Patent
Lee et al.

(10) Patent No.: US 12,746,638 B2
(45) Date of Patent: Sep. 29, 2026

(54) RETAINER RING, CHEMICAL MECHANICAL POLISHING APPARATUS, AND SUBSTRATE POLISHING METHOD

(71) Applicant: SAMSUNG ELECTRONICS CO., LTD., Suwon-si (KR)

(72) Inventors: Sangyun Lee, Suwon-si (KR); Younghun Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 344 days.

(21) Appl. No.: 18/229,026

(22) Filed: Aug. 1, 2023

(65) Prior Publication Data

US 2024/0091902 A1 Mar. 21, 2024

(30) Foreign Application Priority Data

Sep. 15, 2022 (KR) ..... 10-2022-0116687
Feb. 9, 2023 (KR) ..... 10-2023-0017616

(51) Int. Cl.
*B24B 37/32* (2012.01)
*B24B 37/30* (2012.01)
*B24B 57/02* (2006.01)

(52) U.S. Cl.
CPC ..... *B24B 37/32* (2013.01); *B24B 57/02* (2013.01); *B24B 37/30* (2013.01)

(58) Field of Classification Search
CPC ..... B24B 37/042; B24B 37/26; B24B 37/30; B24B 327/228
USPC ..... 451/41, 285, 286, 287, 398
See application file for complete search history.

(56) References Cited

U.S. PATENT DOCUMENTS 5,597,346 A * 1/1997 Hempel, Jr. ..... B24B 53/017 451/36
5,695,392 A * 12/1997 Kim ..... B24B 37/32 451/286
6,224,472 B1 5/2001 Lai et al.
6,293,850 B1 * 9/2001 Lin ..... B24B 37/32 451/60
7,118,456 B2 10/2006 Moloney et al.
7,857,683 B2 12/2010 Burns et al.
(Continued)

FOREIGN PATENT DOCUMENTS

JP 2005-5398 A 1/2005
KR 10-2000-0031807 A 6/2000
(Continued)

OTHER PUBLICATIONS

Wei et al., "Effect of Retaining Ring Slot Design on Slurry Film Thickness during CMP", Electrochemical and Solid-State Letters, 2010, 4 total pages, vol. 13.
(Continued)

*Primary Examiner* — Robert F Neibaur
(74) *Attorney, Agent, or Firm* — Sughrue Mion, PLLC

(57) ABSTRACT

Provided is a retainer ring, a chemical mechanical polishing apparatuses including the same, and a substrate polishing method using the same. A slurry groove is upwardly recessed from a bottom surface of the retainer ring. The slurry groove extends in an arc shape from an inner surface of the retainer ring toward an outer surface of the retainer ring. A curvature radius of the slurry groove is greater than a distance between a center of the retainer ring and a curvature center of the slurry groove.

19 Claims, 16 Drawing Sheets

(56) References Cited

U.S. PATENT DOCUMENTS

| | | | | |
|---|---|---|---|---|
| 8,033,895 | B2 * | 10/2011 | Prabhu | B24B 37/32 451/286 |
| 2007/0298693 | A1 | 12/2007 | Ichinoshime | |

FOREIGN PATENT DOCUMENTS

| | | | |
|---|---|---|---|
| KR | 10-2001-0049587 | A | 6/2001 |
| KR | 10-2005-0064316 | A | 6/2005 |

OTHER PUBLICATIONS

Park et al., "Effects of CMP Retaining Ring Material on the Performance of Wafer Polishing", Journal of the Korean Society of Manufacturing Process Engineers, Mar. 2020, 7 total pages, vol. 19.

* cited by examiner

RETAINER RING, CHEMICAL MECHANICAL POLISHING APPARATUS, AND SUBSTRATE POLISHING METHOD

CROSS-REFERENCE TO RELATED APPLICATIONS

This application is based on and claims priority under 35 U.S.C § 119 to Korean Patent Application No. 10-2022-0116687, filed on Sep. 15, 2022, and Korean Patent Application No. 10-2023-0017616, filed on Feb. 9, 2023, in the Korean Intellectual Property Office, the disclosures of which are incorporated by reference herein in their entirety.

BACKGROUND

1. Field

The present disclosure relates to a retainer ring, a chemical mechanical polishing apparatus, and a substrate processing method. More specifically, the present disclosure relates to a retainer ring that can increase an amount of a slurry being introduced, a chemical mechanical polishing apparatus including the retainer ring, and a substrate processing method using the chemical mechanical polishing apparatus.

2. Description of Related Art

Various processes may be performed to fabricate a semiconductor device. For example, a substrate may undergo a photolithography process, an etching process, and a deposition process in fabricating a semiconductor device. It may be required that a surface of the substrate be planarized prior to each process. A polishing process may be executed on the substrate. The polishing process may be fulfilled in a variety of ways. For example, a chemical mechanical polishing (CMP) process may be used to planarize the substrate and other elements of the semiconductor device.

SUMMARY

According to an aspect of the disclosure, a retainer ring for chemical mechanical polishing is provided. The retainer ring includes: a slurry groove upwardly recessed from a bottom surface of the retainer ring. The slurry groove extends in an arc shape from an inner surface of the retainer ring toward an outer surface of the retainer ring, and a curvature radius of the slurry groove is greater than a distance between a center of the retainer ring and a curvature center of the slurry groove.

According to an aspect of the disclosure, a chemical mechanical polishing apparatus is provided. The chemical mechanical polishing apparatus includes: a platen that supports a polishing pad; and a polishing head on the platen. The polishing head includes: a polishing head body that supports a substrate; and a retainer ring coupled to a bottom surface of the polishing head body, where a bottom surface of the retainer ring comprises a slurry groove that extends from an inner surface of the retainer ring toward an outer surface of the retainer ring, and a curvature radius of the slurry groove is greater than a distance between a center of the retainer ring and a curvature center of the slurry groove.

According to an aspect of the disclosure, a substrate polishing method is provided. The method includes: placing a substrate into a chemical mechanical polishing apparatus, and polishing the substrate. The placing the substrate into the chemical mechanical polishing apparatus includes: placing the substrate on a polishing head that includes: a polishing head body that supports the substrate; and a retainer ring coupled to a bottom surface of the polishing head body, a bottom surface of the retainer ring comprising a plurality of slurry grooves, each of the plurality of slurry grooves being connected to an outer surface of the retainer ring while drawing an arc shape in a counterclockwise direction from an inner surface of the retainer ring. The polishing the substrate includes: rotating the polishing head in a counterclockwise direction to rotate the substrate; rotating a polishing pad; and causing the rotating substrate to contact the rotating polishing pad.

Some embodiments of the present disclosure provide a retainer ring that can increase an amount of introduction of slurry, a chemical mechanical polishing apparatus including the same, and a substrate processing method using the same.

Some embodiments of the present disclosure provide a retainer ring that can reduce noise occurring when a chemical mechanical polishing apparatus is used, a chemical mechanical polishing apparatus including the same, and a substrate processing method using the same.

Some embodiments of the present disclosure provide a retainer ring that can reduce vibration occurring when a chemical mechanical polishing apparatus is used, a chemical mechanical polishing apparatus including the same, and a substrate processing method using the same.

Some embodiments of the present disclosure provide a retainer ring that can increase a removal rate of substrate materials, a chemical mechanical polishing apparatus including the same, and a substrate processing method using the same.

The object of the present disclosure is not limited to the mentioned above, and other objects which have not been mentioned above will be clearly understood to those skilled in the art from the following description.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
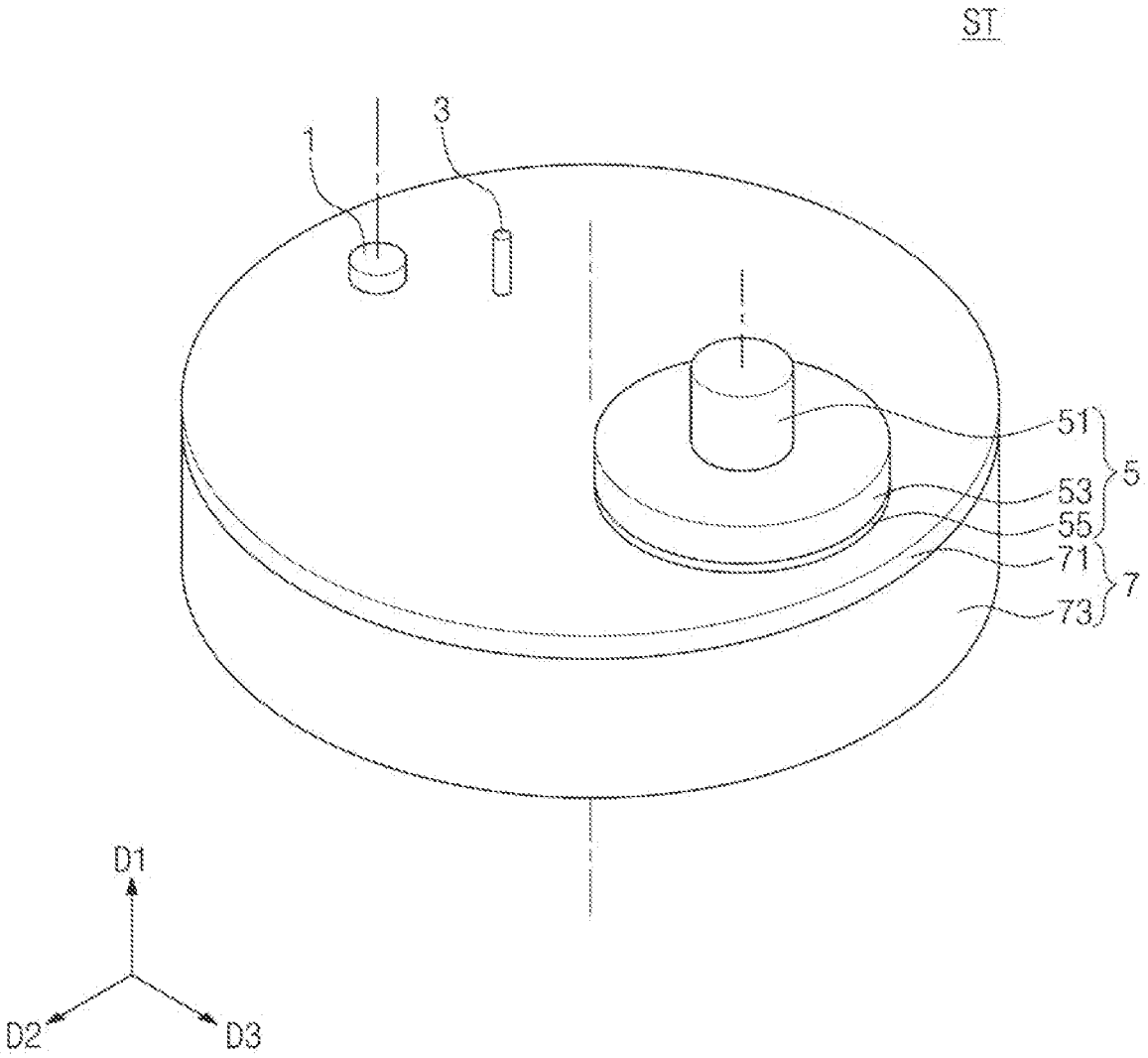
FIG. 1 is a perspective view showing a chemical mechanical polishing apparatus according to an embodiment.

Hereinafter, embodiments of the present disclosure will be described in detail with reference to the accompanying drawings, where similar reference characters denote corresponding features consistently throughout.

In this disclosure, symbol D1 may indicate a first direction along a first axis, symbol D2 may indicate a second direction along a second axis that intersects the first axis, and symbol D3 may indicate a third direction along a third axis that intersects each of the first axis and second axis. The first direction D1 may be called an upward direction, and a direction reverse to the first direction D1 may be called a downward direction. In addition, each of the second and third directions D2 and D3 may be called a horizontal direction.

FIG. 1 is a perspective view showing a chemical mechanical polishing apparatus ST according to an embodiment.

Referring to FIG. 1, a chemical mechanical polishing apparatus ST may be provided. The chemical mechanical apparatus ST may polish one surface of a substrate (e.g., substrate W of FIG. 2). In this description, the term "substrate" may mean a silicon (Si) wafer, but the present disclosure are not limited thereto. The chemical mechanical polishing apparatus ST may include a polishing unit 7, a conditioning unit 1, a slurry supply unit 3, and a polishing head 5.

The polishing unit 7 may include a polishing pad 71 and a platen 73.

The polishing pad 71 may have a disk shape. The polishing pad 71 may be disposed on a top surface of the platen 73. For example, a bottom surface of the polishing pad 71 may be in contact with the top surface of the platen 73. A rotation center of the polishing pad 71 may be positioned on the same line on which a rotation center of the platen 73 is positioned. The polishing pad 71 may polish the substrate W. The polishing pad 71 may rotate. For example, the polishing pad 71 may rotate about a rotation axis parallel to the first direction D1. A top surface of the polishing pad 71 that rotates may polish a bottom surface of the substrate W while being in contact with the substrate W. The polishing pad 71 may be divided into a plurality of sections, but the present disclosure is not limited thereto.

The platen 73 may support the polishing pad 71. The platen 73 may drive the polishing pad 71 to rotate. For example, the platen 73 may rotate by a driving mechanism and drive the polishing pad 71 to rotate. When the polishing pad 71 has a disk shape, the platen 73 may also have a disk shape. The platen 73 may drive the polishing pad 71 to rotate. For example, the substrate W may be polished by the polishing pad 71 that rotates by the rotation of the platen 73.

The conditioning unit 1 may polish a portion of the polishing pad 71. The conditioning unit 1 may be selectively in contact with the top surface of the polishing pad 71. While the polishing pad 71 rotates, the conditioning unit 1 may be in contact with the top surface of the polishing pad 71. The polishing by the conditioning unit 1 may change a state of the top surface of the polishing pad 71 while a polishing process is performed on the substrate W. For example, the conditioning unit 1 may polish the polishing pad 71 to improve a state of the polishing pad 71. The conditioning unit 1 may rotate independently of a polishing apparatus. A relative rotation speed of the conditioning unit 1 with respect to a polishing apparatus may be changed depending on time. In a polishing apparatus, a relative position of the conditioning unit 1 may depend on time. For example, the conditioning unit 1 may move in a horizontal direction on the polishing pad 71. The conditioning unit 1 may ascend in an upward direction from a point where a bottom surface of the conditioning unit 1 is in contact with the polishing pad 71.

The slurry supply unit 3 may supply the polishing pad 71 with slurry. For example, the slurry supply unit 3 may supply the slurry to the top surface of the polishing pad 71 so as to satisfactorily perform a polishing process on the substrate W. The slurry supply unit 3 may be disposed spaced apart from the polishing pad 71. In addition, the slurry supply unit 3 may be positioned between the conditioning unit 1 and a head support member 51. When viewed in a rotation direction of the platen 73, the slurry supply unit 3 may be disposed between the conditioning unit 1 and the polishing head 5. For example, when viewed in a rotation direction of the platen 73, the slurry supply unit 3 may be disposed between a rear end of the conditioning unit 1 and a front end of the polishing head 5.

The polishing head 5 may support and/or rotate the substrate W. For example, the polishing head 5 may place the substrate W on the polishing pad 71 to allow one surface of the substrate W to face toward the polishing pad 71. The polishing head 5 may rotate independently of a polishing apparatus. A relative rotation speed of the polishing head 5 with respect to a polishing apparatus may be changed depending on time. In a polishing apparatus, a relative position of the polishing head 5 may depend on time. For example, the polishing head 5 may move in a horizontal direction on the polishing pad 71. The polishing head 5 may ascend in an upward direction from a point where the substrate W and a bottom surface 55*b* of a retainer ring 55 are in contact with the polishing pad 71. The polishing head 5 may include a head support member 51, a polishing head body 53, and a retainer ring 55.

The head support member 51 may place the substrate W on a certain position on the polishing pad 71. The substrate W may be polished on the polishing pad 71. The head support member 51 may be coupled to the polishing head body 53.

The polishing head body 53 may support the substrate W. The retainer ring 55 and the substrate W may be coupled to a bottom surface of the polishing head body 53. For example, the polishing head body 53 may use a vacuum pressure to cause the substrate W to be adsorbed on the bottom surface of the polishing head body 53. The polishing head body 53 may have a porous structure exposed on the bottom surface thereof. The head support member 51 may be coupled to a top surface of the polishing head body 53.

The retainer ring 55 may be coupled to the polishing head body 53. For example, a top surface 55*u* of the retainer ring 55 may be in contact with the polishing head body 53. The top surface 55*u* of the retainer ring 55 may be coupled to the polishing head body 53. The retainer ring 55 may surround a circumference of the substrate W. This will be further discussed in detail below.

Figure 2:
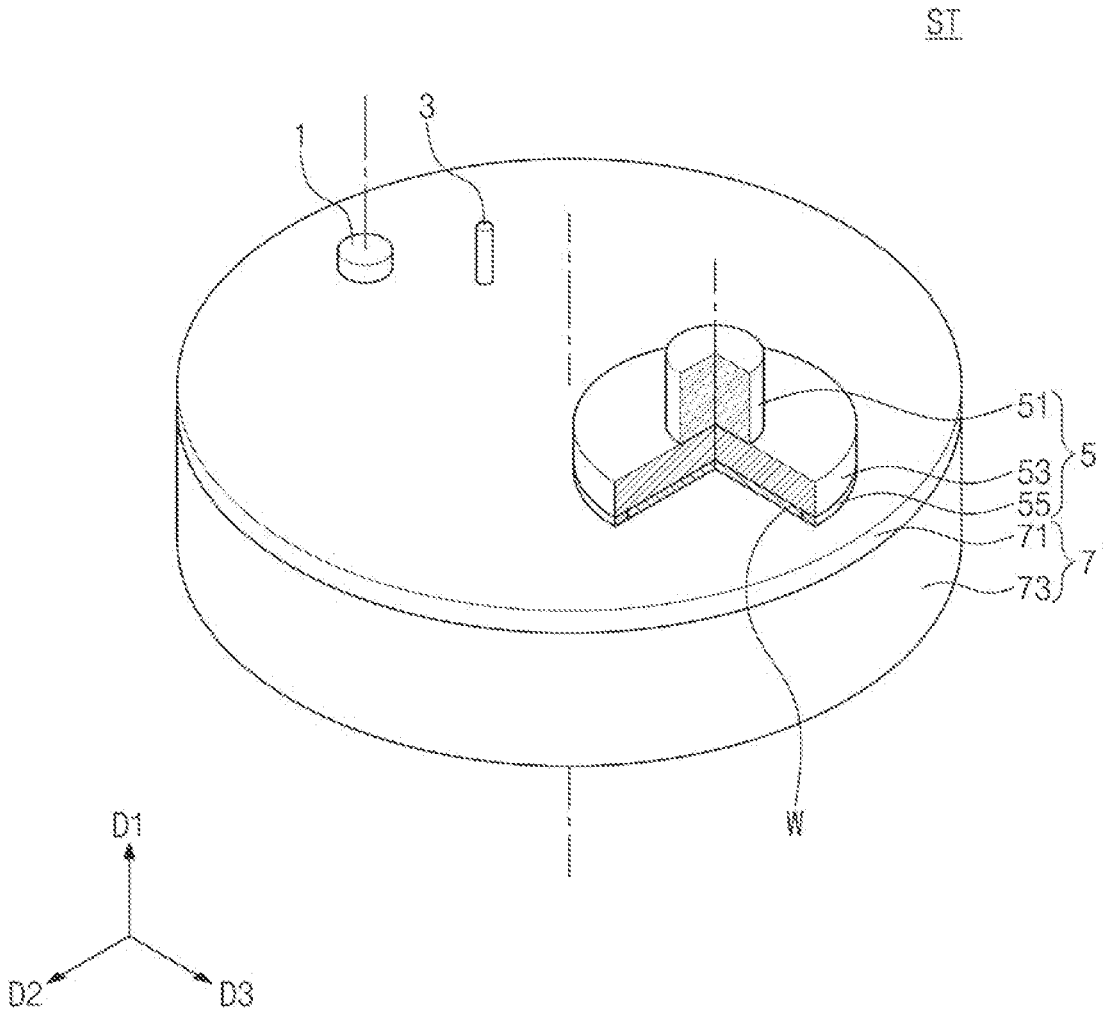
FIG. 2 is a partially-cut perspective view showing a chemical mechanical polishing apparatus according to an embodiment.

FIG. 2 is a partially-cut perspective view showing a chemical mechanical polishing apparatus ST according to an embodiment.

Referring to FIG. 2, the retainer ring 55 may surround a circumference of the substrate W. For example, an inner surface (e.g., inner surface 553 of FIG. 6) of the retainer ring 55 may contact and surround an outer circumference of the substrate W. The retainer ring 55 may have an outer radius (e.g., radius R4 of FIG. 8) that does not exceed a radius of the polishing head body 53. The bottom surface 55*b* of the retainer ring 55 may be in contact with the polishing pad 71. The bottom surface 55*b* of the retainer ring 55 may provide a slurry groove 551. A detailed description thereof will be further discussed below.

Figure 3:
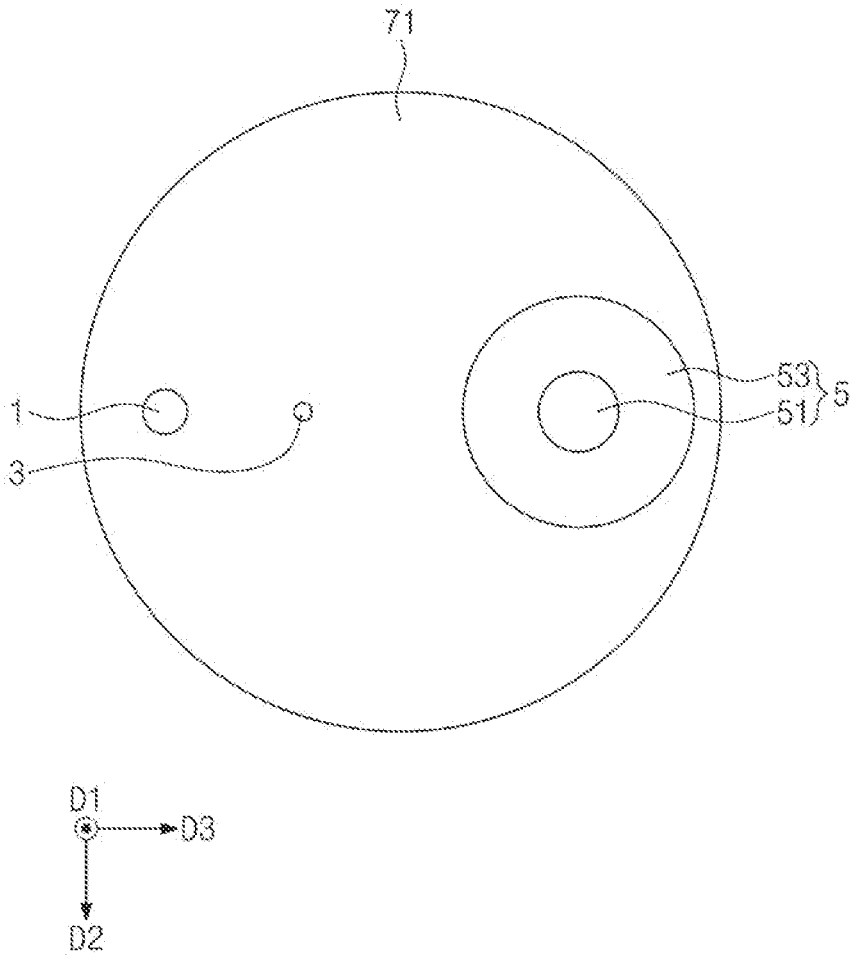
FIG. 3 is a plan view showing a chemical mechanical polishing apparatus according to an embodiment.

FIG. 3 is a plan view showing a chemical mechanical polishing apparatus ST according to an embodiment.

Referring to FIG. 3, the slurry supply unit 3 may be positioned between the conditioning unit 1 and the polishing head 5. For example, a center of the slurry supply unit 3 may be positioned on a line that connects a center of the conditioning unit 1 to a center of the polishing head 5. There may be a change in relative position between the polishing head 5 and the slurry supply unit 3, between the slurry supply unit 3 and the conditioning unit 1, and between the conditioning unit 1 and the polishing head 5.

Figure 4:
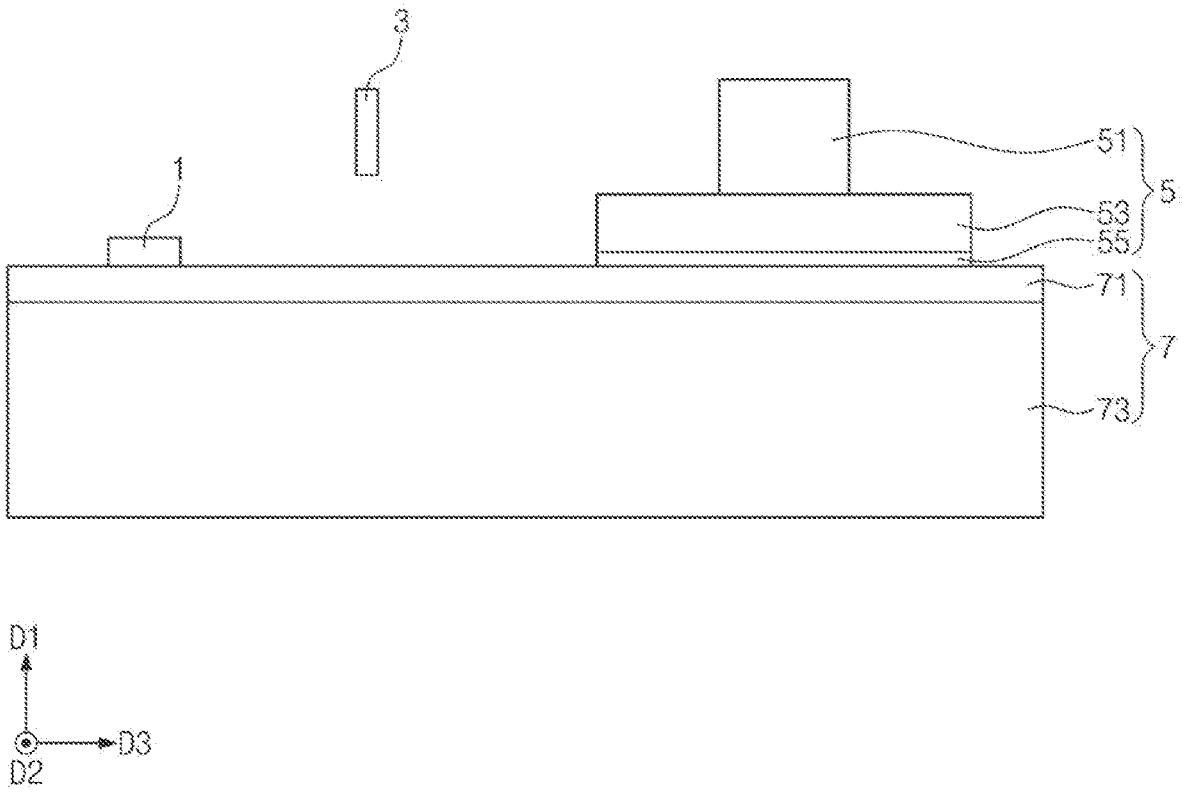
FIG. 4 is a side view showing a chemical mechanical polishing apparatus according to an embodiment.
Figure 5:
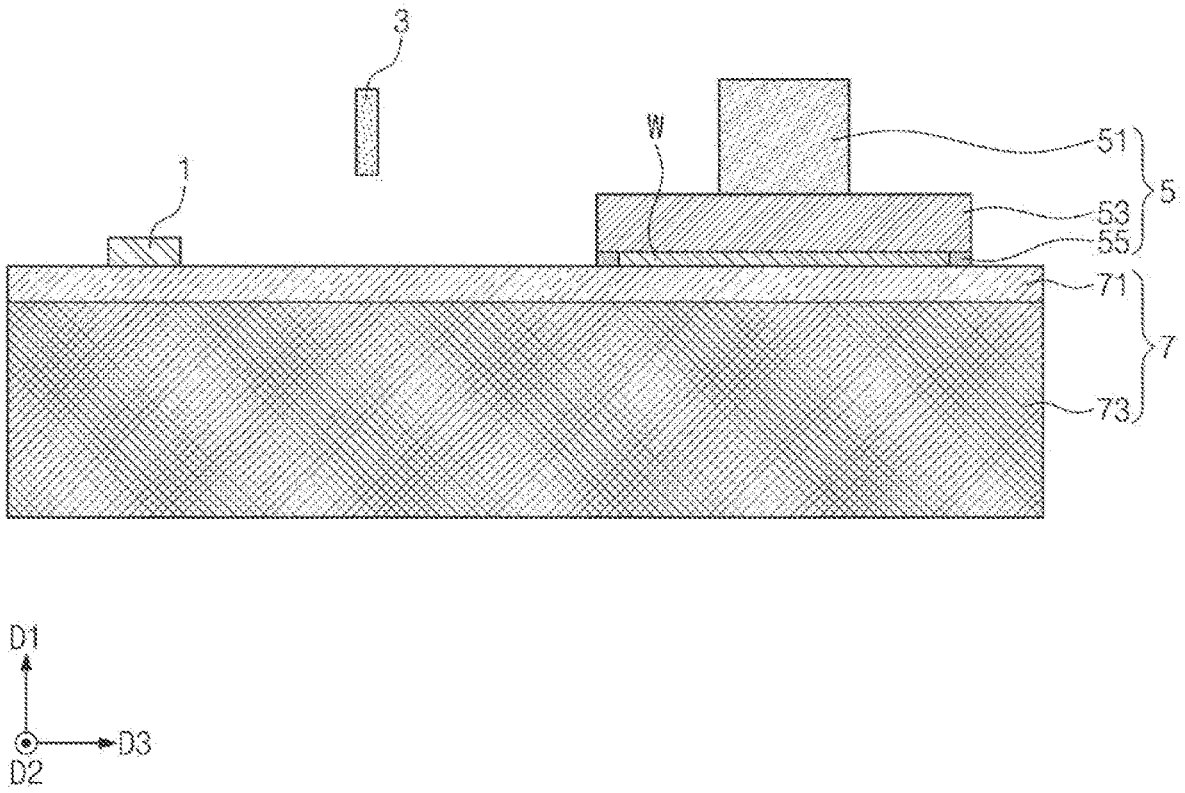
FIG. 5 is a cross-sectional view showing a chemical mechanical polishing apparatus according to an embodiment.

FIG. 4 is a side view showing a chemical mechanical polishing apparatus ST according to an embodiment. FIG. 5 is a cross-sectional view showing a chemical mechanical polishing apparatus ST according to some embodiments of the present disclosure.

Referring to FIGS. 4 and 5, the slurry supply unit 3 may be disposed spaced apart in a vertical direction from an upper end of the polishing pad 71. A lateral surface of the substrate W may be in contact with an inner surface 553 of the retainer ring 55. A top surface of the substrate W may be in contact with the bottom surface of the polishing head body 53. A bottom surface of the substrate W may be in contact with the polishing pad 71.

Figure 6:
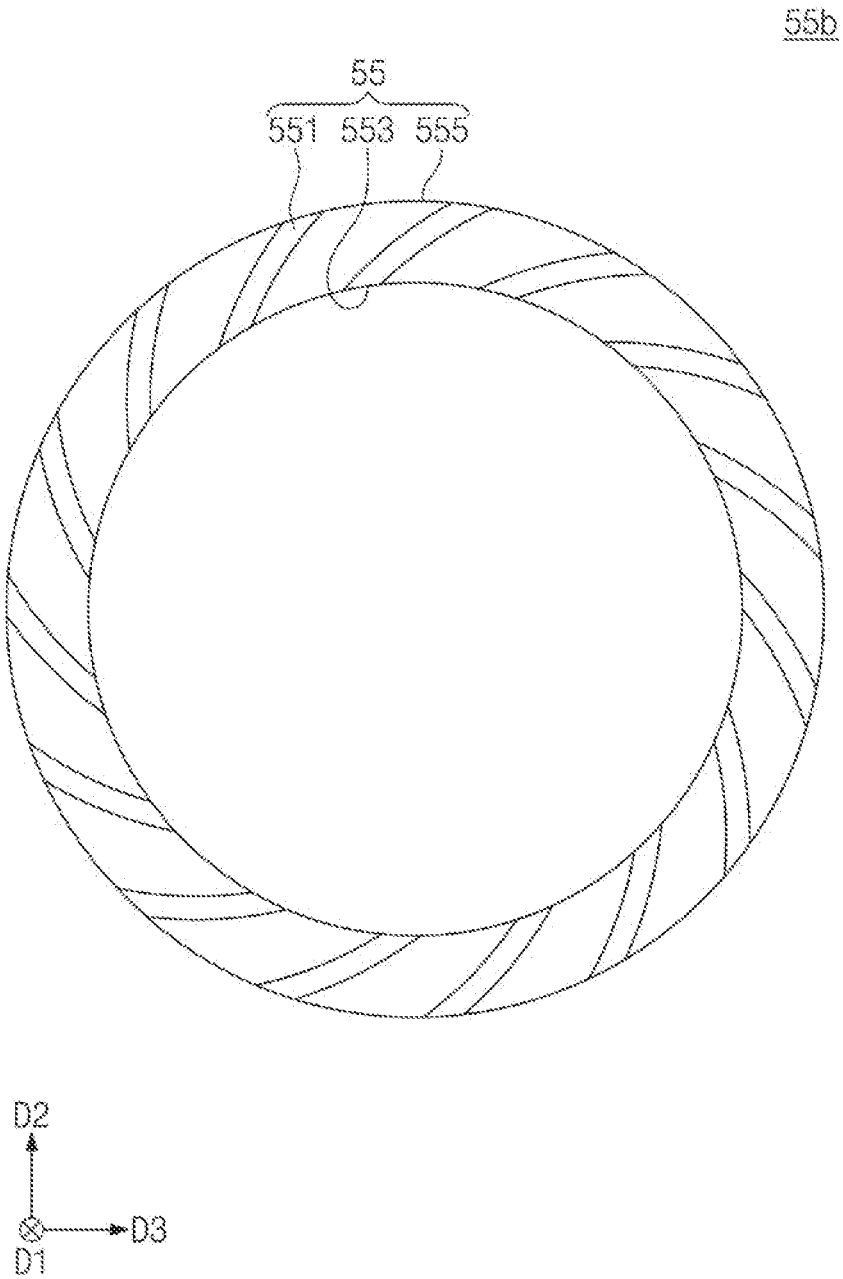
FIG. 6 is a plan view showing a retainer ring according to an embodiment.
Figure 7:
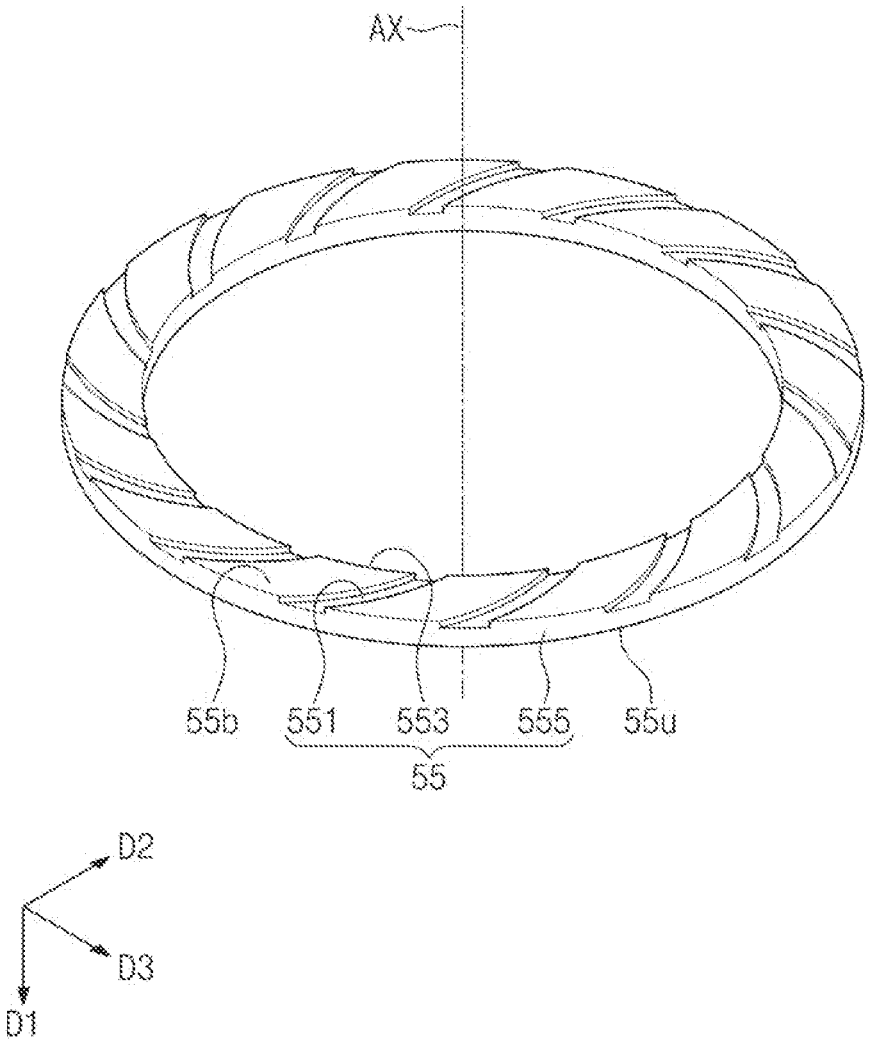
FIG. 7 is a perspective view showing a retainer ring according to an embodiment.

FIG. 6 is a bottom view showing a retainer ring 55 according to an embodiment. FIG. 7 is a perspective view showing a retainer ring 55 according to an embodiment.

Referring to FIGS. 6 and 7, the retainer ring 55 may have an axis AX that extends in the first direction D1. The retainer ring 55 may provide the slurry groove 551. The slurry groove 551 may be formed on the bottom surface 55*b* of the retainer ring 55. For example, the slurry groove 551 may be upwardly recessed from the bottom surface 55*b* of the retainer ring 55 toward the top surface 55*u* of the retainer ring 55. The slurry groove 551 may have a linear or curved shape. The slurry groove 551 may extend in an arc shape from an inner surface 553 of the retainer ring 55 toward an outer surface of the retainer ring 55. According to an embodiment, the retainer ring 55 may provide a plurality of slurry groove 551. The plurality of slurry grooves 551 may be disposed spaced apart in a circumferential direction of the retainer ring 55. The number of the plurality of slurry grooves 551 may range from about 12 to about 20. Unless otherwise stated, a single slurry groove 551 will be described in the interest of convenience. The slurry groove 551 may have a depth of about 2.5 mm to about 4.0 mm. For example, the slurry groove 551 may have a depth of about 3.2 mm. The present disclosure, however, are not limited thereto. The depth of the slurry groove 551 may be less than a thickness of the retainer ring 55. Therefore, the slurry groove 551 may not be connected to the top surface 55*u* of the retainer ring 55. The slurry groove 551 may have a width of about 5 mm to about 7 mm. For example, the slurry groove 551 may have a width of about 6 mm.

Figure 8:
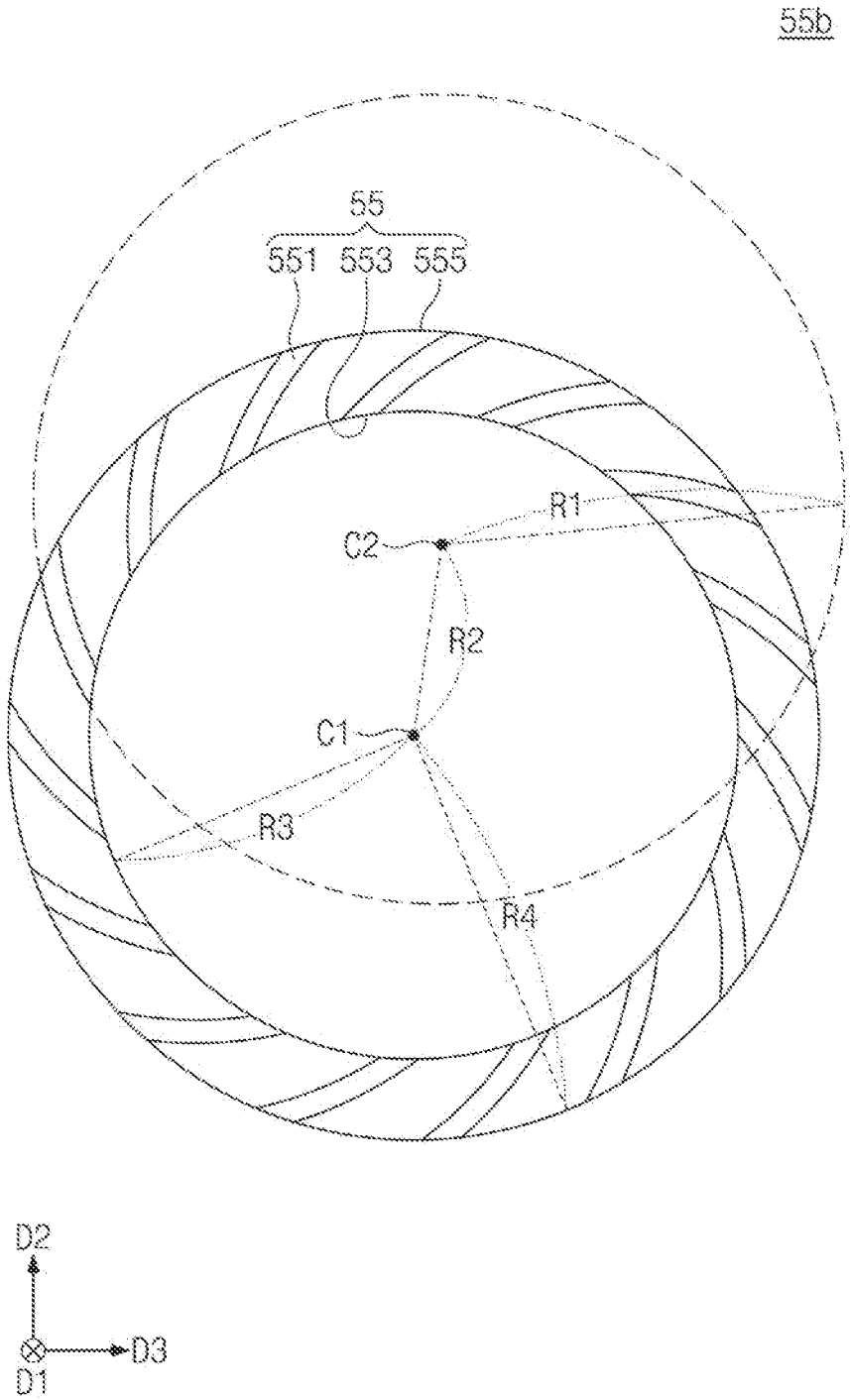
FIG. 8 is a plan view showing a retainer ring according to an embodiment.

FIG. 8 is a plan view showing the retainer ring 55 according to an embodiment.

Referring to FIG. 8, a center C1 of the retainer ring 55 may be defined. The center C1 of the retainer ring 55 may be positioned on the axis (e.g., axis AX of FIG. 7) of the retainer ring 55. An inner surface 553 of the retainer ring 55 may have a radius R3 that means a distance between the center C1 and the inner surface 553 of the retainer ring 55. An outer surface 555 of the retainer ring 55 may have a radius R4 that means a distance between the center C1 and the outer surface 555 of the retainer ring 55.

Referring to FIG. 8, a curvature radius R1 of the slurry groove 551 may be defined. The curvature radius R1 of the slurry groove 551 may indicate a radius of an imaginary circle that passes through the slurry groove 551. For example, the curvature radius R1 of the slurry groove 551 may indicate a distance between a curvature center C2 of the imaginary circle that passes through the slurry groove 551 and an imaginary circle that passes through the slurry groove 551.

The curvature radius R1 of the slurry groove 551 may be greater than a distance R2 between the center C1 of the retainer ring 55 and the curvature center C2 of the slurry groove 551. A range of about 60 mm to about 75 mm may be given to the distance R2 between the center C1 of the retainer ring 55 and a curvature center C2 of the slurry groove 551. For example, a value of about 68 mm may be given to the distance R2 between the center C1 of the retainer ring 55 and a curvature center C2 of the slurry groove 551. The curvature radius R1 of the slurry groove 551 may range from about 115 mm to about 145 mm. The curvature radius R1 of the slurry groove 551 may be greater than the radius R3 of the inner surface 553 of the retainer ring 55. The radius R3 of the inner surface 553 of the retainer ring 55 may range from about 90 mm to about 110 mm. The curvature radius R1 of the slurry groove 551 may be greater than the radius R4 of the outer surface 555 of the retainer ring 55. The radius R4 of the outer surface 555 of the retainer ring 55 may range from about 120 mm to about 130 mm. For example, a value of about 123 mm may be given to the radius R4 of the outer surface 555 of the retainer ring 55.

Figure 9:
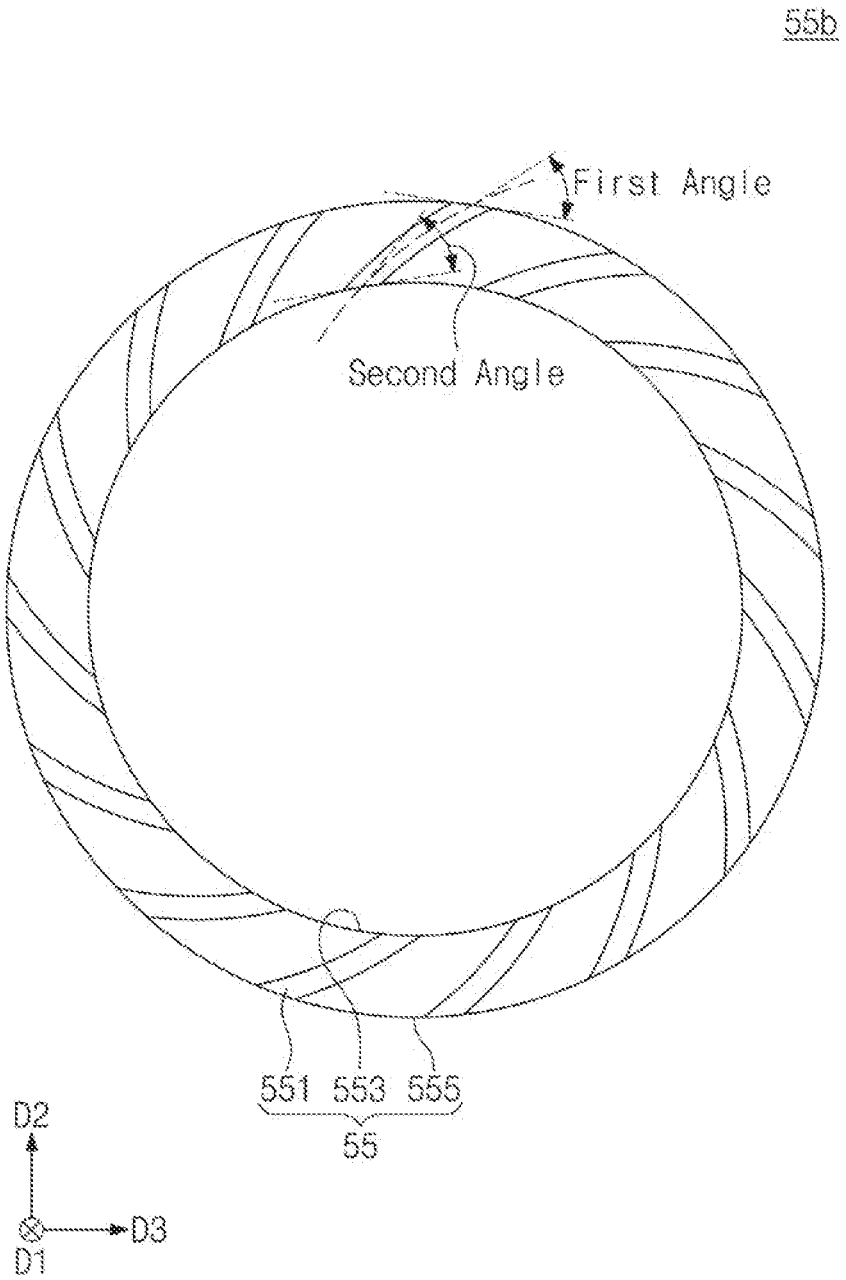
FIG. 9 is a plan view showing a retainer ring according to an embodiment.
Figure 10:
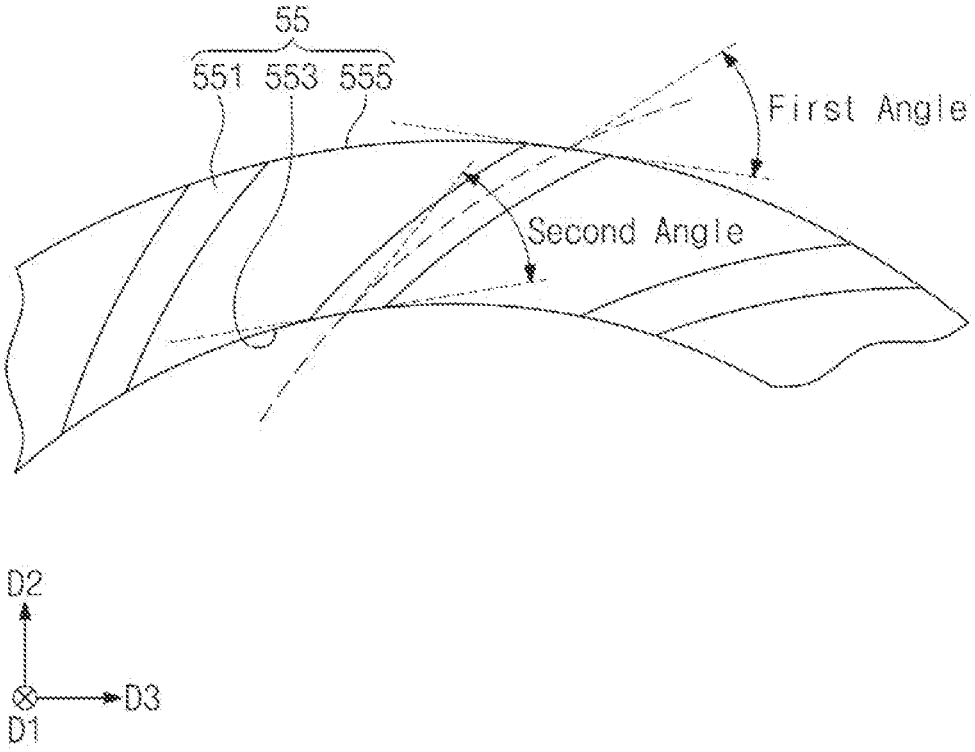
FIG. 10 is an enlarged plan view partially showing a retainer ring according to an embodiment.

FIG. 9 is a bottom view showing the retainer ring 55 according to an embodiment. FIG. 10 is an enlarged plan view partially showing the retainer ring 55 according to an embodiment.

Referring to FIGS. 9 and 10, a first angle may be defined as an angle between the slurry groove 551 and the outer surface 555 of the retainer ring 55. At an intersection between the slurry groove 551 and the outer surface 555 of the retainer ring 55, the first angle may indicate an angle between the slurry groove 551 and the outer surface 555 of the retainer ring 55. For example, at the intersection between the slurry groove 551 and the outer surface 555, the first angle may denote an angle between the slurry groove 551 and a tangent line of the outer surface 555.

A second angle may be defined as an angle between the slurry groove 551 and the inner surface 553 of the retainer ring 55. At an intersection between the slurry groove 551 and the inner surface 553 of the retainer ring 55, the second angle may indicate an angle between the slurry groove 551 and the inner surface 553 of the retainer ring 55. For example, at the intersection between the slurry groove 551 and the inner surface 553, the second angle may denote an angle between the slurry groove 551 and a tangent line of the inner surface 553.

The first angle may range from about 20° to about 50°. For example, the first angle may be about 31°. The second angle may range from about 20° to about 50°. The first angle and the second angle may be substantially the same as or similar to each other. For example, each of the first and second angles may be about 30°. The present disclosure, however, is not limited thereto.

Figure 11:
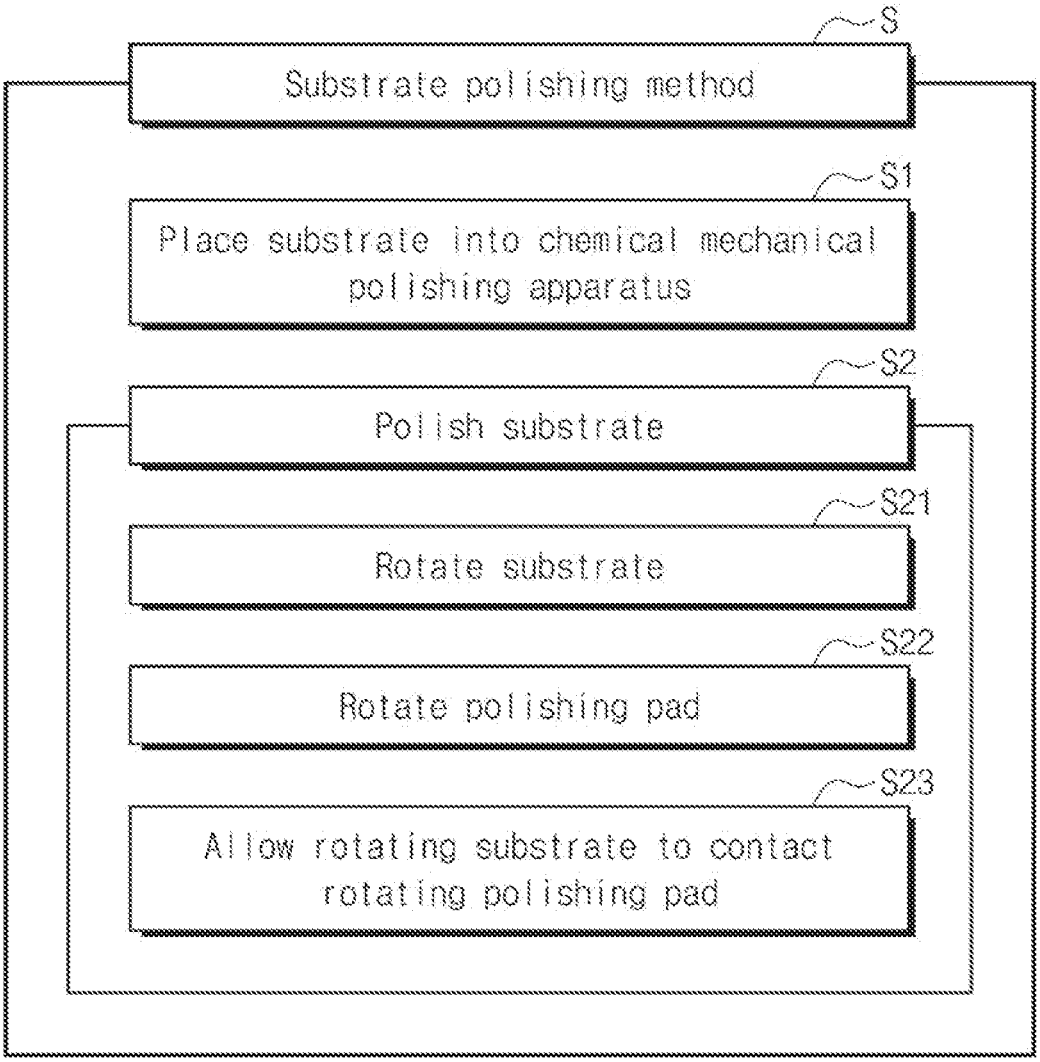
FIG. 11 is a flow chart showing a substrate polishing method according to an embodiment.

FIG. 11 is a flow chart showing a substrate polishing method S according to an embodiment.

Referring to FIG. 11, the substrate polishing method S may be provided. The substrate polishing method S may be a method of polishing the substrate W by using the chemical mechanical polishing apparatus ST discussed with reference to FIGS. 1-10. The substrate polishing method S may include placing the substrate W into the chemical mechanical polishing apparatus ST (51) and polishing the substrate W (S2). The polishing of the substrate W (S2) may include rotating the substrate W (S21), rotating the polishing pad 71 (S22), and allowing the rotating substrate W to contact the rotating polishing pad 71 (S23).

FIGS. 12-16 are perspective and plan views showing the substrate polishing method S according to the flow chart of FIG. 11.

Figure 12:
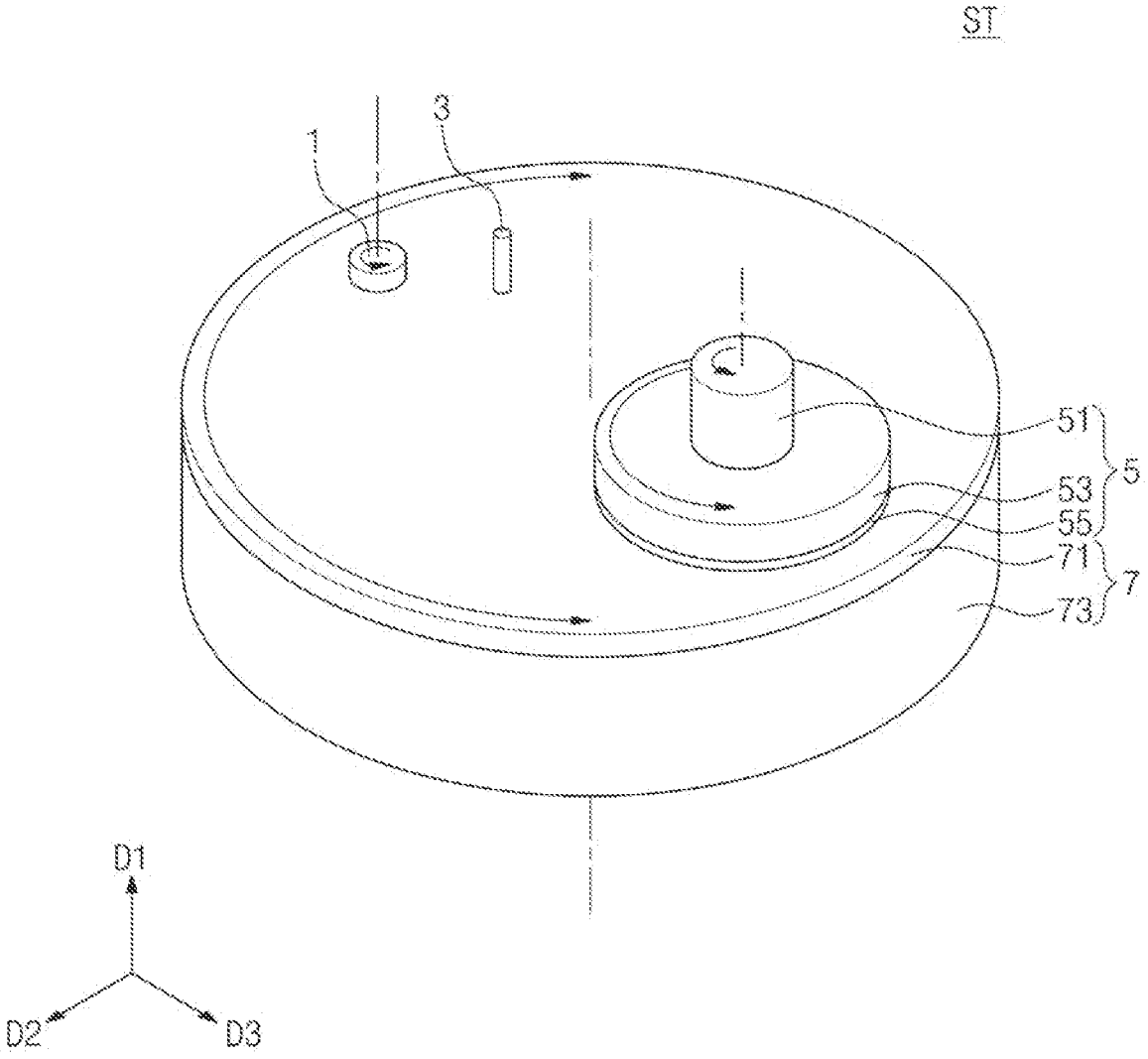
FIG. 12 is a perspective view showing a substrate polishing method according to the flow chart of FIG. 11.
Figure 13:
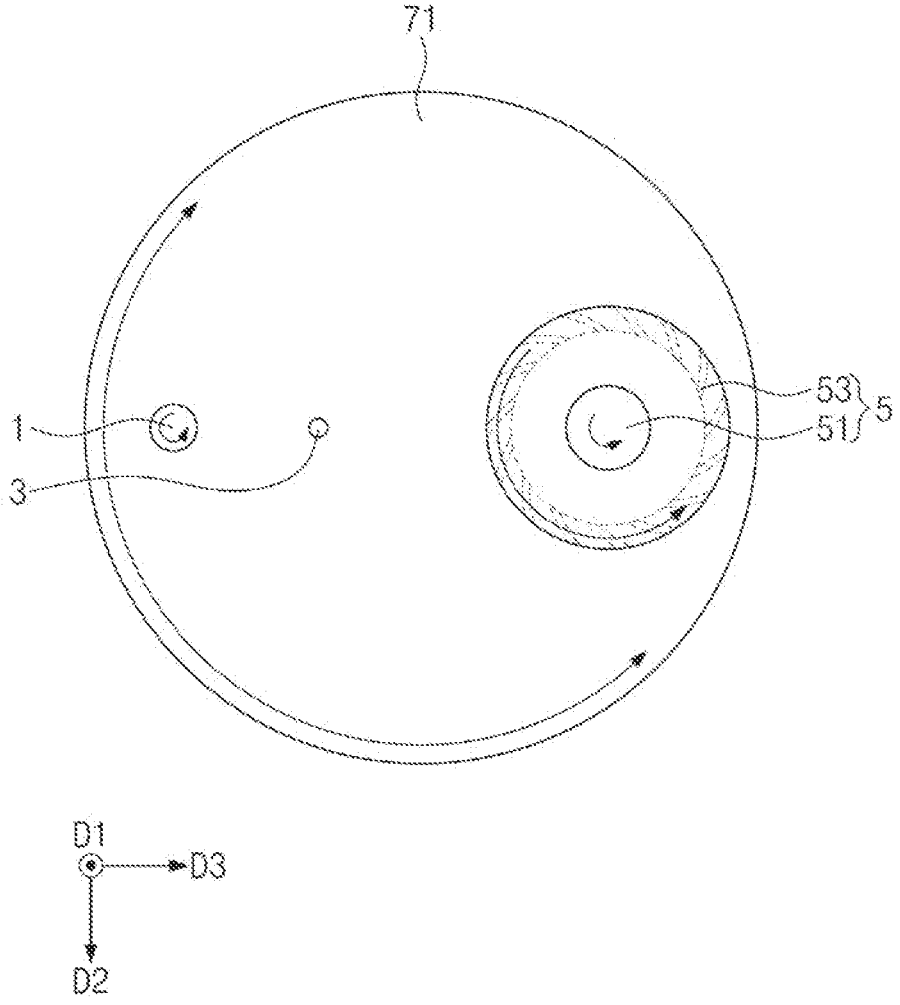
FIG. 13 is a plan view showing a substrate polishing method according to the flow chart of FIG. 11.

Referring to FIGS. 12 and 13, the substrate placement operation 51 may include placing the substrate W on the polishing head 5. The polishing head 5 may include the polishing head body 53 that supports the substrate W, and may also include the retainer ring 55 coupled to the bottom surface of the polishing head body 53. The substrate polishing method S may include driving the polishing pad 71 to rotate in a counterclockwise direction. Alternatively, the substrate polishing method S may include driving the polishing pad 71 to rotate in a clockwise direction. For example, the substrate polishing method S may include allowing the counterclockwise rotating substrate W to contact the counterclockwise rotating polishing pad 71. For another example, the substrate polishing method S may include allowing the counterclockwise rotating substrate W to contact the clockwise rotating polishing pad 71. In this operation, there may be a change in relative rotation speed of the substrate W with respect to the polishing pad 71. There may be a change in relative rotation direction of the substrate W with respect to the polishing pad 71. A relative position of the substrate W with respect to the polishing pad 71 may be changed depending on time.

Figure 14:
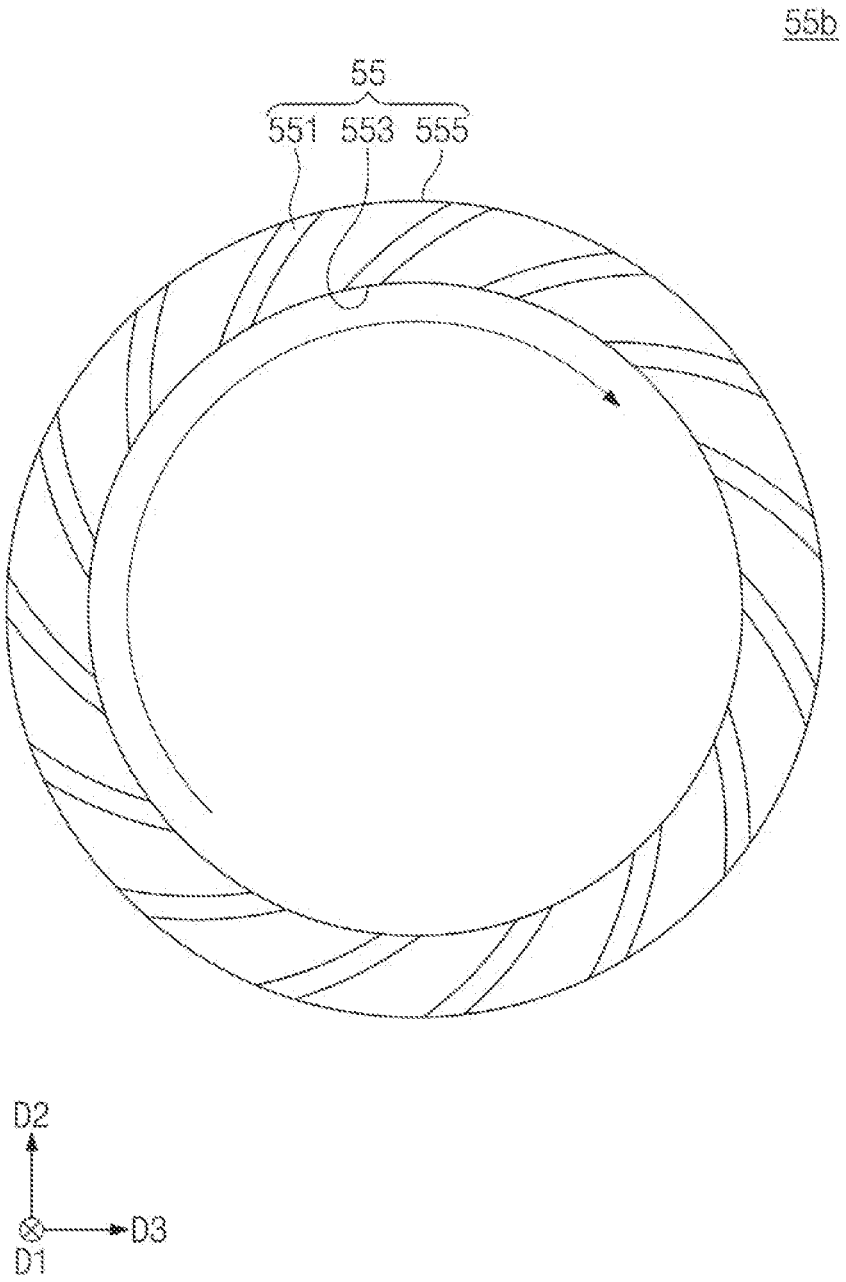
FIG. 14 is a plan view showing a substrate polishing method according to the flow chart of FIG. 11.

Referring to FIG. 14, when viewed in plan, the slurry groove 551 may be connected to the outer surface 555 of the retainer ring 55 while drawing an arc shape in a counterclockwise direction from the inner surface 553 of the retainer ring 55. The term "when viewed in plan" used in this disclosure may mean a point of view from top as illustrated in FIG. 14. The retainer ring 55 may rotate in a counterclockwise direction when viewed in plan. The retainer ring 55 may rotate in a clockwise direction based on a bottom view. For example, the retainer ring 55 may rotate in a direction in which the slurry groove 551 extends from the inner surface 553 to the outer surface 555 of the retainer ring 55.

Figure 15:
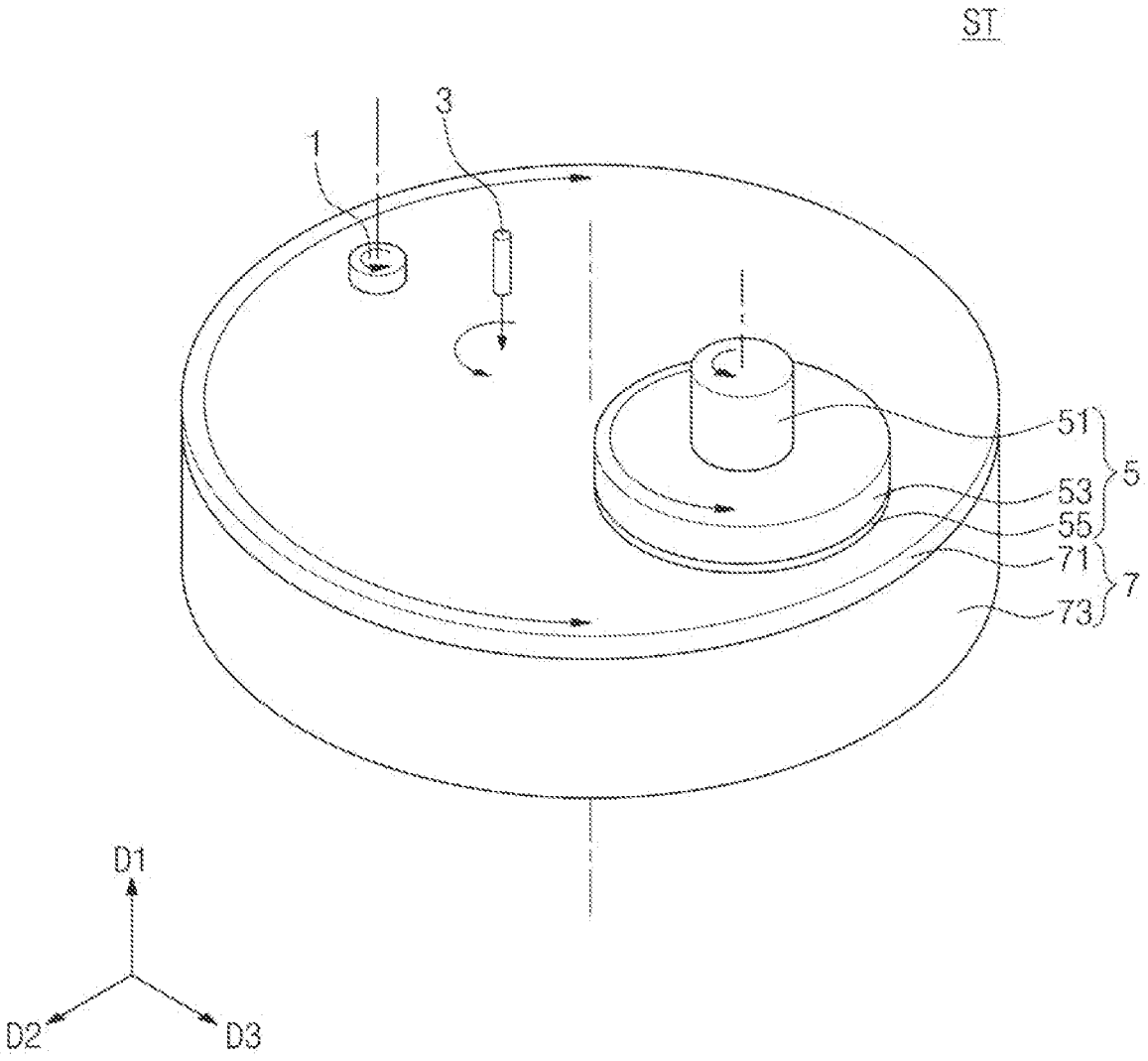
FIG. 15 is a perspective view showing a substrate polishing method according to the flow chart of FIG. 11.
Figure 16:
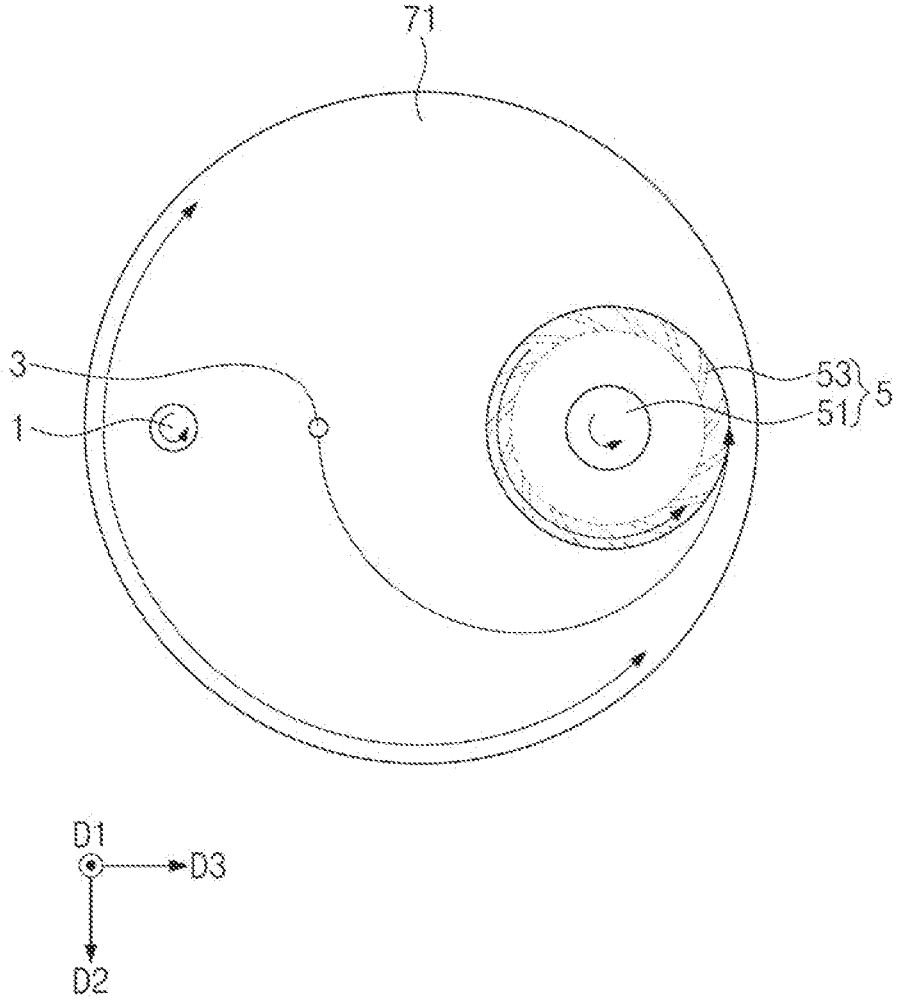
FIG. 16 is a plan view showing a substrate polishing method according to the flow chart of FIG. 11.

Referring to FIGS. 15 and 16, slurry supply unit 3 may supply slurry to the polishing pad 71. The slurry supplied from the slurry supply unit 3 may be directly sprayed to neither the conditioning unit 1 nor the polishing head 5. As the slurry is supplied to the polishing pad 71 that rotates, the slurry may flow in a counterclockwise direction while drawing an arc on the polishing pad 71. The flowing slurry may be introduced into the retainer ring 55. For example, the slurry may be introduced into the retainer ring 55 through the slurry groove 551 provided on the bottom surface (e.g., bottom surface 55*b* of FIG. 7) of the retainer ring 55. The slurry introduced into the retainer ring 55 may be in contact with the bottom surface of the substrate (e.g., substrate W of FIG. 2).

According to a retainer ring, a chemical mechanical polishing apparatus including the same, and a substrate polishing method using the same in accordance with an embodiment, it may be possible to increase an amount of introduction of slurry provided to an inside of the retainer ring and a bottom surface of a substrate. When a curved shape is given to a slurry groove provided on a bottom surface of the retainer ring, there may be an increase in amount of slurry that passes through the slurry groove that rotates. For example, when the slurry groove draws a gentle curve because a curvature radius of the slurry groove is greater than a radius of the retainer ring, the slurry provided on a polishing pad may favorably pass through the retainer ring that rotates. For example, when the curvature radius of the slurry groove is greater than an inner diameter and/or an outer diameter of the retainer ring, the slurry may satisfactorily pass through the retainer ring.

According to a retainer ring, a chemical mechanical polishing apparatus including the same, and a substrate polishing method using the same in accordance with an embodiment, it may be possible to reduce noise and vibration occurring when the chemical mechanical polishing apparatus is used. There may be an increase in removal rate of materials included in a substrate when the chemical mechanical polishing apparatus is used. For example, because there is an increase in amount of introduction of slurry supplied to the substrate, it may be possible to reduce noise and vibration occurring when the chemical mechanical polishing apparatus is used. In addition, costs may be reduced and work efficiency may be increased by increasing a removal rate of materials included in the substrate and decreasing an amount of slurry consumption.

According to a retainer ring, a chemical mechanical polishing apparatus including the same, and a substrate polishing method of the present disclosure, it may be possible to increase an amount of introduction of slurry.

According to a retainer ring, a chemical mechanical polishing apparatus including the same, and a substrate polishing method of the present disclosure, it may be possible to reduce noise occurring when the chemical mechanical polishing apparatus is used.

According to a retainer ring, a chemical mechanical polishing apparatus including the same, and a substrate polishing method of the present disclosure, it may be possible to reduce vibration occurring when the chemical mechanical polishing apparatus is used.

According to a retainer ring, a chemical mechanical polishing apparatus including the same, and a substrate polishing method of the present disclosure, it may be possible to increase a removal rate of materials included in a substrate.

Effects of the present disclosure are not limited to those mentioned above, and other effects which have not been mentioned above will be clearly understood to those skilled in the art from the accompanying description.

The embodiments of the present disclosure have been shown and described above with reference to the accompanying drawings. The embodiments disclosed in the specification and drawings are only intended to provide specific examples for easily describing the technical content of the disclosure and for assisting understanding of the disclosure, and are not intended to limit the scope of the disclosure. It will be understood by those of ordinary skill in the art that the present disclosure may be easily modified into other detailed forms without changing the technical principle or essential features of the present disclosure, and without departing from the gist of the disclosure as claimed by the appended claims and their equivalents. Therefore, it should be interpreted that the scope of the disclosure includes all changes or modifications derived based on the technical idea of the disclosure in addition to the embodiments disclosed herein.

What is claimed is:

1. A retainer ring for chemical mechanical polishing, comprising:

a slurry groove upwardly recessed from a bottom surface of the retainer ring, wherein the slurry groove extends in an arc shape from an inner surface of the retainer ring toward an outer surface of the retainer ring, wherein a curvature radius of the slurry groove is greater than a distance between a center of the retainer ring and a curvature center of the slurry groove, and wherein the curvature radius of the slurry groove is greater than a radius of the inner surface.

2. The retainer ring of claim 1, wherein a first angle between the slurry groove and the outer surface of the retainer ring at an intersection between the slurry groove and the outer surface of the retainer ring is the same as a second angle between the slurry groove and the inner surface of the retainer ring at an intersection between the slurry groove and the inner surface of the retainer ring.

3. The retainer ring of claim 2, wherein the first angle is between 20° and 50°.

4. The retainer ring of claim 1, further comprising:

a plurality of slurry grooves, each slurry groove in the plurality of slurry grooves being upwardly recessed from the bottom surface of the retainer ring, wherein the plurality of slurry grooves are spaced apart from each other in a circumferential direction.

5. The retainer ring of claim 4, wherein the plurality of slurry grooves comprise between 12 and 20 slurry grooves.

6. The retainer ring of claim 1, wherein the distance between the center of the retainer ring and the curvature center of the slurry groove is between 60 mm and 75 mm.

7. The retainer ring of claim 6, wherein the curvature radius of the slurry groove is between 115 mm and 145 mm.

8. The retainer ring of claim 1, wherein the radius of the inner surface is between 90 mm and 110 mm.

9. The retainer ring of claim 1, wherein the curvature radius of the slurry groove is greater than a radius of the outer surface.

10. The retainer ring of claim 1, wherein a depth of the slurry groove is between 2.5 mm and 4.0 mm.

11. The retainer ring of claim 1, wherein a width of the slurry groove is between 5 mm and 7 mm.

12. A chemical mechanical polishing apparatus, comprising:

a platen that supports a polishing pad; and a polishing head on the platen, the polishing head comprising:

a polishing head body that supports a substrate; and a retainer ring coupled to a bottom surface of the polishing head body, wherein a bottom surface of the retainer ring comprises a slurry groove, wherein the slurry groove extends from an inner surface of the retainer ring toward an outer surface of the retainer ring, wherein a curvature radius of the slurry groove is greater than a distance between a center of the retainer ring and a curvature center of the slurry groove, and wherein the curvature radius of the slurry groove is greater than a radius of the inner surface.

13. The apparatus of claim 12, wherein a first angle between the slurry groove and a tangent line of the outer surface of the retainer ring at an intersection between the slurry groove and the outer surface of the retainer ring is the same as a second angle between the slurry groove and a tangent line of the inner surface of the retainer ring at an intersection between the slurry groove and the inner surface of the retainer ring.

14. The apparatus of claim 13, further comprising:

a plurality of slurry grooves provided on the bottom surface of the retainer ring, the plurality of slurry grooves being spaced apart from each other in a circumferential direction, and the first angle is between 20° and 50°.

15. The apparatus of claim 14, wherein the plurality of slurry grooves comprise between 12 and 20 slurry grooves.

16. A substrate polishing method, comprising:

placing a substrate into a chemical mechanical polishing apparatus, wherein placing the substrate into the chemical mechanical polishing apparatus comprises:

placing the substrate on a polishing head, the polishing head comprising:

a polishing head body that supports the substrate; and a retainer ring coupled to a bottom surface of the polishing head body, a bottom surface of the retainer ring comprising a plurality of slurry grooves, each of the plurality of slurry grooves being connected to an outer surface of the retainer ring while drawing an arc shape in a counterclockwise direction from an inner surface of the retainer ring, wherein a curvature radius of each the plurality of slurry grooves is greater than a radius of the inner surface; and polishing the substrate, wherein polishing the substrate comprises:

rotating the polishing head in a counterclockwise direction to rotate the substrate;

rotating a polishing pad; and causing the rotating substrate to contact the rotating polishing pad.

17. The method of claim 16, wherein a first angle between a slurry groove in the plurality of slurry grooves and the outer surface of the retainer ring at an intersection between the slurry groove and the outer surface of the retainer ring is the same as a second angle between the slurry groove and the inner surface of the retainer ring at an intersection between the slurry groove and the inner surface of the retainer ring.

18. The method of claim 16, wherein the curvature radius of each of the plurality of slurry grooves is greater than a distance between a center of the retainer ring and a curvature center of the slurry groove.

19. The method of claim 16, wherein the plurality of slurry grooves comprise between 12 and 20 slurry grooves.

* * * * *